US005357842A

United States Patent [19]

Reynolds

[11] Patent Number: 5,357,842

[45] Date of Patent: Oct. 25, 1994

[54] RECOIL REDUCING DEVICE

[76] Inventor: Charles E. Reynolds, 1341 S. River Dr., Tempe, Ariz. 85281

[21] Appl. No.: 88,388

[22] Filed: Jul. 9, 1993

[51] Int. Cl.[5] ..... F41A 21/36
[52] U.S. Cl. ..... 89/14.3
[58] Field of Search ..... 42/79; 89/14.3, 14.4

[56] References Cited

U.S. PATENT DOCUMENTS

| | | | |
|---|---|---|---|
| 2,451,514 | 10/1948 | Sieg | 89/14.3 |
| 2,883,781 | 4/1959 | Harvey | 89/14.3 |
| 4,459,895 | 7/1984 | Mazzanti | 89/14.3 |
| 4,747,225 | 5/1988 | Gstettner et al. | 42/76.02 |
| 4,930,396 | 6/1990 | Johnson | 89/14.3 |
| 4,930,397 | 6/1990 | Seidler | 89/14.3 |
| 5,036,747 | 8/1991 | McClain III | 89/14.3 |
| 5,092,223 | 3/1992 | Hudson | 89/14.3 |

FOREIGN PATENT DOCUMENTS

| | | | |
|---|---|---|---|
| 911148 | 6/1946 | France | 89/14.4 |
| 931300 | 2/1948 | France | 89/14.3 |
| 578369 | 6/1958 | Italy | 89/14.3 |
| 8453 | 3/1894 | Switzerland | 89/14.4 |
| 445821 | 4/1936 | United Kingdom | 89/14.3 |

*Primary Examiner*—Bentley Stephen C.
*Attorney, Agent, or Firm*—Dowell & Dowell

[57] ABSTRACT

A recoil reducing device for use with firearms including handguns and rifles which includes a core and a sleeve that surrounds the core. The core and the sleeve each have a plurality of radially directed openings along their lengths that are cooperatively aligned with respect to each other. The openings are oriented with respect to a central bore of the core such that combustion gases generated by firing the firearm, noise and any unburnt gunpowder are directed away from a shooter, and recoil and muzzle rise of a firearm are substantially reduced.

19 Claims, 2 Drawing Sheets

RECOIL REDUCING DEVICE

BACKGROUND OF THE INVENTION

1. Field of the Invention

This invention relates to a recoil reducing device for use with firearms, and, more particularly, to a recoil reducing device that directs hot combustion gases generated during firing, associated firing noise and unburnt gunpowder in a direction away from the shooter, and substantially reduces recoil and muzzle rise.

2. Discussion of the Related Art

It has been known in the art to attach recoil reducing devices to firearms, including handguns, rifles and shotguns, to reduce the amount of recoil generated when firearms are fired. Such known devices have generally been attached to the muzzle end of the barrels of the firearms. The known devices have defined a longitudinal bore in axial communication with the bore of the firearm barrel, and a plurality of radially directed openings extending from the inner diameters of the devices to their outer surfaces. The radially directed openings have had various orientations relative to the bore axes of these devices. They have been provided to function as alternate flow paths for the hot combustion gases created during firing so that all of the combustion gases are not forced to exit at the discharge end of the device. Some of the combustion gases flow away from the direction of the bore axis, and consequently reduce the amount of recoil in comparison to firearms not having such attached recoil reducing devices.

The known devices have comprised muzzle brakes as exemplified by U.S. Pat. Nos. 4,930,396 to Johnson, 4,930,397 to Seidler and 5,036,747 to McClain, III; compensators as exemplified by U.S. Pat. No. 2,451,514 to Seig; and other similar recoil reducing devices as exemplified by U.S. Pat. Nos. 2,883,781 to Harvey and 4,459,895 to Mazzanti, Italian Patent No. 578,369 and British Patent No. 445,821.

The known recoil reducing devices have defined bores, and along their lengths radially directed gas flow openings emanating from the bores. These openings have been arranged at varying directions and angles with respect to their bore axes, and, accordingly, the bore axes of the firearms to which they have been attached. The known devices have defined radial openings oriented perpendicular and at oblique angles, both forwardly and rearwardly relative to their bore axes.

For example, Harvey discloses a device that reduces recoil. The device defines perpendicularly oriented radial openings that are undesirable because only a limited amount of the combustion gases traveling through the bore of the device can abruptly change their direction of travel so as to enter the radial openings and be expelled therethrough. Consequently, most of the combustion gases still exit the bore at the discharge end of the device, as would be the case if the firearm did not have the attached device of Harvey. Therefore, recoil is not adequately reduced.

Other recoil reducing devices have been provided that include radially directed openings oriented at oblique angles relative to their bore axes such as disclosed in Johnson, Seidler, McClain III and British Patent No. 445,821. The radial openings in the Johnson and Seidler devices are angled forwardly relative to a perpendicular line extending relative to their bore axes, and direct expelled combustion gases in about the same forward directions. The radial openings include forward walls with which the gases collide during travel through the openings. Such collisions cause some of the momentum of the traveling gases to be transferred to the device as a forward directed force that urges the firearm forwardly away from the shooter, and, consequently, reduces the amount of recoil.

The McClain device also includes forwardly angled radial openings, and associated baffles positioned in surrounding relationship to the radial openings that direct the gases that have passed through the radial openings in a rearward direction toward the shooter. The collision of the expelled gases with the baffles causes some of their momentum to be transferred to the firearm and directed forwardly along the longitudinal length of the device so as to reduce the amount of recoil. The baffles, however, at the same time cause the undesirable and potentially dangerous effect of deflecting the expelled gases and their associated noise, as well as any unburnt gunpowder, toward the shooter.

British Patent No. 445,821 discloses a recoil reducing device which includes radially directed openings, each having an inner portion directed forwardly of a line extending perpendicularly to the bore axis, and an outer portion directed rearwardly of the perpendicular line through the remainder of the thickness of the longitudinal wall of the device. The outer rearwardly angled portions direct the expelled gases toward the shooter. Thus, this device is also inadequate.

Italian Patent No. 578,369 discloses a recoil reducing device including radially directed openings each having an inner portion oriented perpendicularly to the bore axis, and an outer portion directed rearwardly relative to the perpendicular. The inner and outer portions of the openings are in flow communication with each other. The outer portions direct the expelled gases toward the shooter, and thus this device is also inadequate.

Mazzanti discloses a recoil reducing device defining radial openings oriented perpendicular to its bore axis. The openings include beveled portions at their rear walls that direct the combustion gases against the forward walls of the openings. The escaping gases collide with the forward walls and are deflected rearwardly at an oblique angle relative to the bore axis, again toward the shooter.

Finally, the Seig recoil reducing device defines radial openings including inner forwardly angled portions, and outer rearwardly oriented deflecting flanges associated with the inner portions, defining spaces therebetween. Ports are located in flow communication with the openings and spaces through which the combustion gases finally escape from the device after being deflected by the flanges.

In view of the known recoil reducing devices, there has been a need for a recoil reducing device defining radial openings therein such that firearm recoil and muzzle rise are substantially reduced, and expelled combustion gases and associated noise, and unburnt gunpowder, are directed substantially away from the shooter to eliminate these undesirable and potentially hazardous aspects associated with prior art recoil reducing devices.

SUMMARY OF THE INVENTION

The present invention has been made in view of the above inadequacies of the prior art and has as an object to provide a recoil reducing device for use with firearms including handguns and rifles which can be easily attached to them.

It is another object of the present invention to provide a recoil reducing device including radially directed openings for directing combustion gases generated by the firing of a firearm in a direction away from the bore axis of the device to reduce the amount of recoil and muzzle rise.

It is a further object of the present invention to provide a recoil reducing device defining an arrangement of radially directed openings such that substantially all of the expelled combustion gases, noise and unburnt gunpowder are directed away from the shooter.

To achieve the objects of the invention, as embodied and broadly described herein, the recoil reducing device of the present invention includes a core defining a bore having a bore axis, and including an inner longitudinal cylindrical wall. The inner longitudinal wall includes a plurality of inner openings that are substantially forwardly oriented at an oblique angle relative to the bore axis.

The recoil reducing device in accordance with the present invention further includes a sleeve that is positioned in surrounding relationship to the core. The sleeve includes an outer longitudinal wall which has a plurality of outer openings that are oriented perpendicularly to the bore axis and are in flow communication with the inner openings. The outer openings direct substantially all of the combustion gases expelled from inner openings of the core of the device during firing away from the shooter.

In another embodiment of the present invention, the forward walls of the inner openings include portions that are oriented substantially perpendicularly to the bore axis.

DETAILED DESCRIPTION OF THE PREFERRED EMBODIMENTS

The preferred embodiments of the present invention will now be described in detail with reference to the accompanying drawings.

Figure 1:
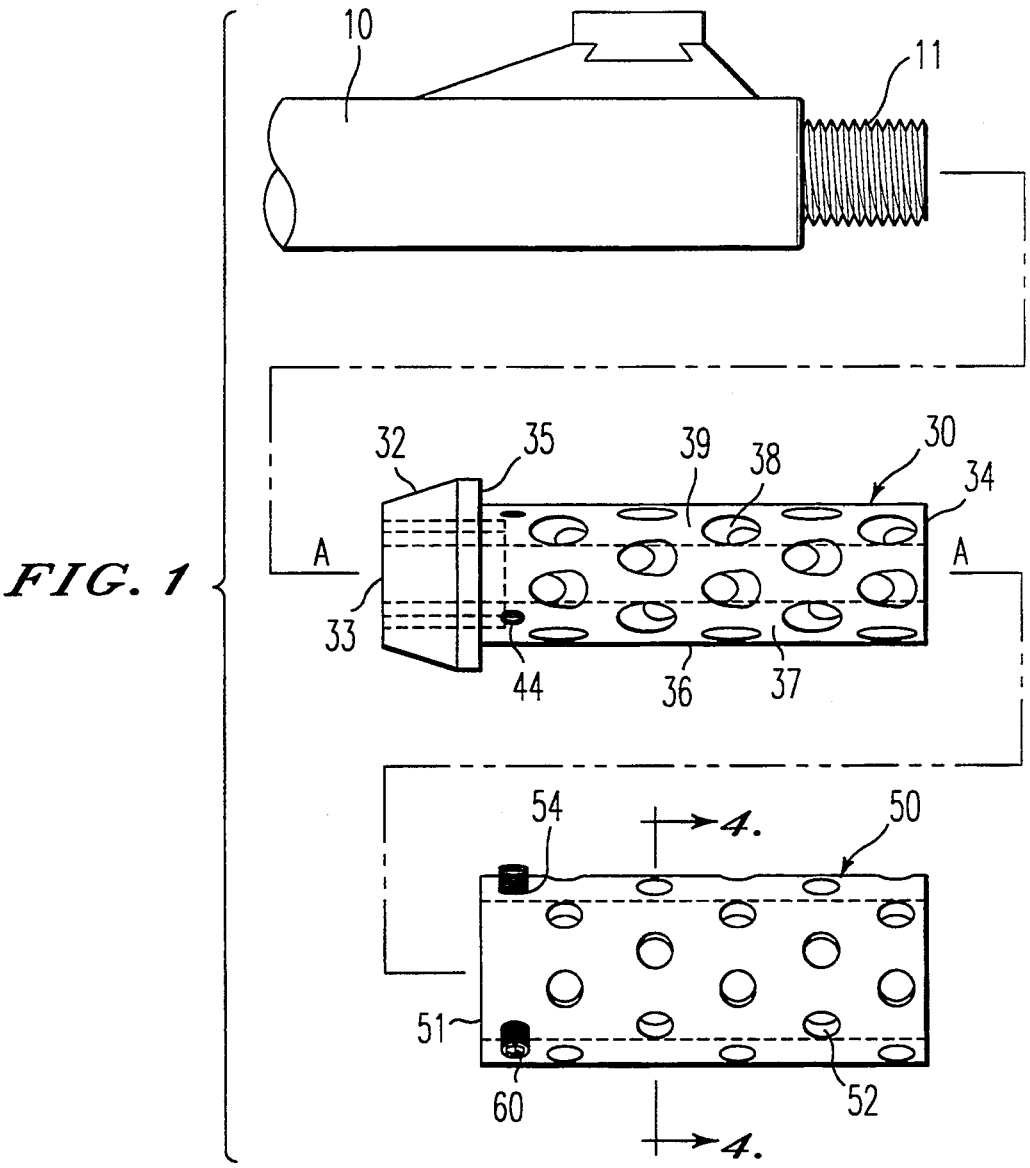
FIG. 1 is an assembly view illustrating a firearm barrel and a core and a sleeve of a recoil reducing device in accordance with a first embodiment of the present invention.
Figure 2:
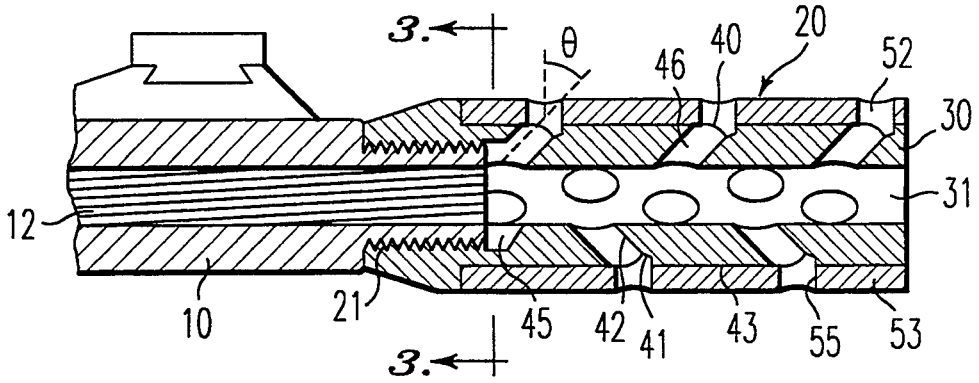
FIG. 2 is a cross-sectional view of the firearm barrel and recoil reducing device of FIG. 1 in the assembled condition.

FIGS. 1 and 2 illustrate a recoil reducing device 20 in accordance with the present invention attached to an end portion of a barrel 10 of a firearm. The barrel includes exterior male threads 11 at an end portion as best shown in FIG. 1. The threads 11 are engaged with female threads 21 of the recoil reducing device that are located within its rear end portion as will be described in greater detail below. The firearm may be a handgun or a rifle, and may be of essentially any caliber.

In accordance with the present invention, the recoil reducing device includes a core 30 as illustrated in FIG. 1. The core defines a cylindrical bore 31 along its entire length. The cylindrical bore has an inner diameter that is substantially equal to the inner diameter 12 of the barrel. The inner diameter of the device may be varied along the length of the device to control the flow of the combustion gases therethrough as will be described in greater detail below. The inner diameter may also be varied to make the device compatible with the barrels of firearms of different calibers.

The core includes an enlarged conical portion 32 at its rear end. The enlarged portion has an outer diameter that increases along the direction of the bore axis A—A of the device from the rear end 33 toward the front or discharge end 34 thereof. The enlarged portion includes a flat annular shoulder 35 that is substantially perpendicular to the bore axis.

The cylindrical bore includes female threads 21 at its rear end, which extend toward the front end of the device to a position adjacent the shoulder 35 as illustrated in FIG. 2. The female threads have a configuration such that the recoil reducing device can be fitted directly to the exterior male threads on a barrel in order to attach the device to a firearm, as illustrated in FIG. 2.

In those instances when the recoil reducing device is not attached to a firearm, a cap (not shown) including interior female threads and a bore coinciding with the bore of the firearm may be attached to the exterior threaded end of the firearm.

The core 30 includes an elongated cylindrical portion 36 integral with the enlarged portion. The elongated cylindrical portion 36 includes an inner wall 37 having a plurality of inner openings 38 through its thickness. In accordance with the present invention, the inner openings emanate from the circumferential wall 39 of the bore and are substantially forwardly oriented at an oblique angle $\Theta$ relative to the bore axis. Preferably, the oblique angle equals approximately 45° (±5°) so that the combustion gases are distributed away from the bore to the greatest possible extent. As illustrated in FIG. 2, the inner openings preferably each include a countersunk portion 40 that may have a concave shape. The countersunk portions terminate at their forward ends at arcuate-shaped forward wall portions 41 of the inner openings. The axis of the countersunk portions intersects the axis of the innermost portions at an angle so as to direct emanating gases generally perpendicularly with respect to the bore axis. The forward wall portions 41 and the forward wall portions 42 together define the forward faces of the inner openings. The forward wall portions 41 are adjacent to the outer surface 43 of the elongated cylindrical portion of the core.

Figure 7:
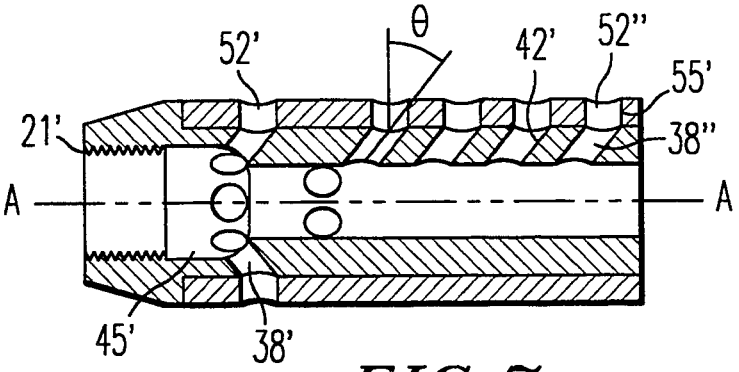
FIG. 7 is a cross-sectional view of the recoil reducing device illustrated in FIG. 5.

In accordance with another embodiment of the present invention, the inner openings may be oriented forwardly at an oblique angle relative to the longitudinal axis along their entire length as illustrated in FIG. 7. That is, the inner openings 38' may be formed without the countersunk portions illustrated in FIG. 2.

In accordance with the present invention, the recoil reducing device further includes a sleeve 50 that is positioned in surrounding relationship to the core. The sleeve has a length that is substantially equivalent to the length of the elongated cylindrical portion 36 of the core. The sleeve is fitted over the elongated cylindrical portion so that its rear face 51 abuts the shoulder 35 of the core as illustrated in FIG. 2.

The sleeve 50 has a plurality of outer openings 52 which extend through the thickness of its outer longitudinal wall 53. In accordance with the invention, the outer openings are oriented substantially perpendicularly to the bore axis of the recoil reducing device. The outer openings are preferably circular shaped, but may optionally have other shapes such as oval.

In accordance with the invention, the number of outer openings in the outer longitudinal wall of the sleeve may be varied, and preferably corresponds to the number of inner openings in the inner longitudinal wall of the core. When the sleeve is placed in surrounding relationship to the core, each of the outer openings are aligned with an associated inner opening so as to form a plurality of pairs of openings extending through the core and the sleeve of the recoil reducing device. These pairs of openings serve as side discharging flow paths for the hot, pressurized combustion gases. In fact, the vast majority of the gases are discharged through these radial openings, and not through the front, discharge end of the device.

The openings may be formed in different patterns about the core and the sleeve so as to control the discharge of combustion gases from the device. For example, in the embodiment of the recoil reducing device illustrated in FIGS. 1 and 2, the inner and outer openings are located about longitudinal walls of the sleeve and core in a repeating pattern so as to effect substantially uniform gas discharge from the device. In the embodiment illustrated in FIGS. 5–7, however, there are two sets of inner and outer openings 38', 52' and 38", 52".

The first set of openings 38', 52' are generally equally spaced about the periphery of the device adjacent the conical portion 32' and allow discharge of gases uniformly from the device. The second set of openings 38", 52", however, extend longitudinally along only a portion of the device. In the illustrated embodiment, two rows of openings 38" and 52" are used. The second set of openings are preferably located along the upper portion of the device to provide a thrust or force to offset the natural tendency of the firearm to rise during recoil. The gases exhausting from the second set of openings will force the barrel of the firearm in a downward direction.

In accordance with the present invention, the recoil reducing device is preferably composed of an alloy such as a chromium-molybdenum alloy or a tool steel. Other like alloys may also be used. Preferably, the chosen material is the same material used to form the barrel of the firearm so that both the firearm and the recoil reducing device may be simultaneously subjected to a blueing treatment.

Figure 3:
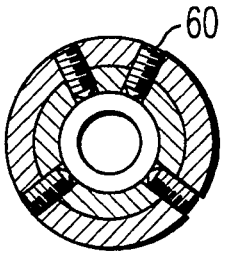
FIG. 3 is a cross-sectional taken in the direction of line 3—3 of FIG. 2.
Figure 4:
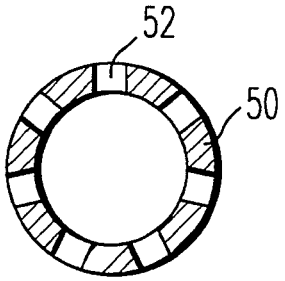
FIG. 4 is a cross-sectional view taken in the direction of line 4—4 of FIG. 1.

In accordance with the present invention, the recoil reducing device further comprises means for preventing relative motion between the sleeve and the core when the firearm is fired. Preferably, at least one outer threaded hole 54 is formed in the sleeve near its rear end 51 as illustrated in FIG. 1. At least one threaded hole 44 is also formed in the elongated cylindrical portion 36 of the core, adjacent to the shoulder. The outer threaded hole extends completely through the thickness of the outer longitudinal wall, while the inner threaded hole extends only partially through the thickness of the inner longitudinal wall. The inner and outer threaded holes are located so that they are necessarily aligned with each other when the sleeve is fitted over the core and the inner and outer openings are aligned with each other. A fastener 60 such as an Allen screw is inserted in the outer hole and rotated until its bottom face abuts the bottom wall of the inner opening as best illustrated in FIG. 3. Additional pairs of inner and outer threaded holes for receiving fasteners may be formed at other positions about the circumferences of the sleeve and the elongated portion of the core.

The means for preventing relative motion between the sleeve and core may optionally be one or more welds formed therebetween. The welds may be formed at the location of the interface between the sleeve and the shoulder of the core, or at the front end of the device around the interface between the elongated cylindrical portion of the core and the sleeve.

The function of the recoil reducing device in accordance with the present invention will now be described in greater detail. The recoil reducing device is attached to the exteriorly threaded end of a barrel of a firearm. When the firearm is fired, the bullet travels through the bore of the barrel and exits at the discharge end of the recoil reducing device. The hot, high-pressure combustion gases created by the burning of the gunpowder of the cartridge travel through the bore of the barrel behind the bullet. A small portion of the gases are expelled through the discharge end of the recoil reducing device. The remainder of the gases are expelled through the radially directed inner and outer openings as a natural consequence of the compressed hot gases attempting to expand to decrease their pressure during their travel through the device. The present inventor has determined that the amount of gases that are expelled through the radial openings can be maximized by forming the inner openings of the core forwardly and at about a 45° angle relative to the bore axis of the device.

The present inventor has also determined that gas discharge through the radial openings can be enhanced by varying the diameter of the bore of the recoil reducing device along its length. More particularly, the diameter of the bore may include an enlarged portion 45, 45' located immediately forwardly of the inner female threads of the core, and of the same diameter as the bore of the gun barrel for the remaining forward portion of the bore. This bore configuration causes the combustion gases to expand in the enlarged portion of the bore, and consequently have a greater tendency to enter the radial openings and be discharged therethrough.

With reference to FIGS. 1 and 2, after the combustion gases have passed through the inclined portions 46 of the inner openings, the gases, still traveling at a high velocity, collide with the forward wall portions 41 of the inner openings and the forward walls 55 of the outer openings 52. These collisions transfer some of the momentum of the gases to the recoil reducing device as a force acting along the direction of the bore axis of the device. This force acts in the direction opposite to the normal rearward recoil of the firearm caused by gases being expelled from the discharge end of the firearm, so as to reduce or substantially eliminate recoil.

The inner openings 38' illustrated in FIG. 7 are oriented at an oblique angle relative to the bore axis A—A along their entire length. Accordingly, the combustion gases have a lesser tendency to impact with the forward walls 42' of the inner openings in comparison to the embodiment of the present invention illustrated in FIG.

2 and described above, and accordingly travel substantially in the direction of the inner openings therethrough. The gases collide with the forward walls 55' of the outer openings to again cause some of the momentum of the gases to be transferred to the device as a force acting along the direction of the bore axis as in the above-described embodiment. The magnitude of this force is slightly less than the magnitude of the force created in the above-described embodiment. However, in this embodiment the combustion gases would be expelled from the device at substantially the same angle relative to the bore axis, i.e., 90°. Because the shooter experiences reduced recoil, shooting discomfort is reduced. Furthermore, at the same time, shooting accuracy is improved because the shooter can more easily maintain the firearm in the proper position during firing.

After the combustion gases traverse the inner openings, they enter and travel through the outer openings in a direction substantially perpendicular to the bore axis, and are expelled from the device in about that same direction. Consequently, the gases are directed away from the shooter, as also is the noise associated with the combustion of the gunpowder. Accordingly, the shooter is exposed to less noise and the danger of suffering hearing damage is reduced. The remaining small portion of the combustion gases, noise and unburnt gunpowder travel through the cylindrical bore of the recoil reducing device and exit through the discharge end.

Because the outer openings are oriented perpendicular to the bore axis of the recoil reducing device, muzzle rise is also reduced or essentially eliminated. Accordingly, shooting accuracy is improved yet further in comparison to firearms having attached thereto one of the known recoil reducing devices.

In accordance with the present invention, the number and size of the inner and outer openings may be varied to control their total cross-sectional area so as to make the device compatible with firearms having a range of different calibers. For example, the total cross-sectional area of the openings would be increased for firearms of increasing caliber so as to be capable of expelling the increasing volume of combustion gases associated therewith, to acceptably reduce the increased recoil and muzzle rise associated with the increasing caliber firearms. The total cross-sectional area of the openings may be increased by increasing either the number of openings, or their cross-sectional diameter.

Figure 5:
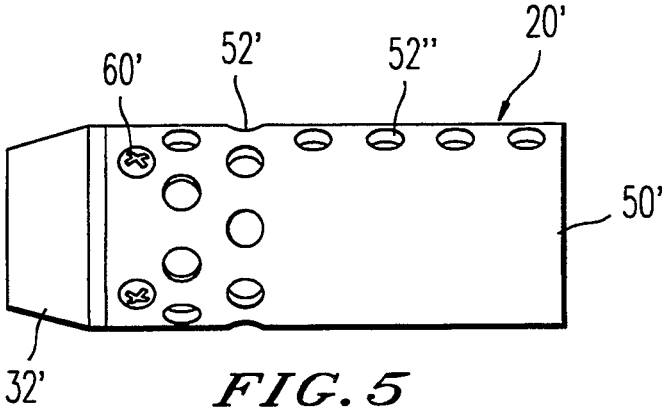
FIG. 5 is a side elevational view of a recoil reducing device in accordance with a second embodiment of the present invention.
Figure 6:
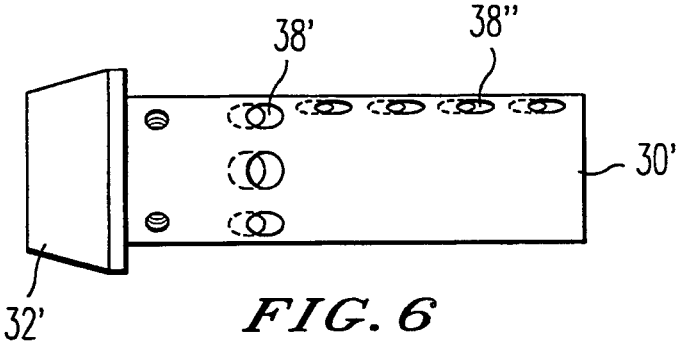
FIG. 6 is a side elevational view of a core of a recoil reducing device in accordance with the second embodiment of the present invention as illustrated in FIG. 5.

Regarding the pattern of the openings, preferably the openings are uniformly located with respect to both the length and circumferences of the core and sleeve. Such uniform location of the openings directs the expelled gases radially and uniformly from the bore, and accordingly substantially reduces muzzle rise. As explained above, the openings may, however, be formed in other patterns so as to cause the gases to be expelled in a particular direction as illustrated in FIGS. 5–7 and as discussed earlier in this specification.

The foregoing description of the preferred embodiments of the invention have been presented to illustrate the principles of the invention and not to limit the invention to the particular embodiments illustrated. It is intended that the scope of the invention be defined by all of the embodiments encompassed within the following claims, and their equivalents.

What is claimed is:

1. A recoil reducing device for use with a firearm, comprising:

a core having an inner end portion, an outer surface, a cylindrical bore defining a bore axis and an inner longitudinal wall, a plurality of inner openings through said inner longitudinal wall and being substantially forwardly oriented at an oblique angle relative to said bore axis; and a sleeve surrounding said core, said sleeve including a rear face and an outer longitudinal wall, said outer longitudinal wall contacting the outer surface of said inner longitudinal wall along substantially the length of said outer longitudinal wall, a plurality of outer openings through said outer longitudinal wall being oriented perpendicularly to said bore axis and directly aligned in open communication with said inner openings such that substantially all gases expelled from the firearm during firing are directed away from a shooter.

2. The recoil reducing device of claim 1, wherein said core includes interior threads at said inner end portion for attaching said device to the firearm.

3. The recoil reducing device of claim 1, wherein said oblique angle being approximately 45°.

4. The recoil reducing device of claim 1, including first and second sets of inner and outer openings, said first set being generally equally spaced about the periphery of said recoil reducing device, and said second set being disposed longitudinally along only a portion of the periphery of said recoil reducing device.

5. The recoil reducing device of claim 1, wherein said inner and outer openings have a generally cylindrical shape and are generally equally spaced along the length of and about said recoil reducing device.

6. The recoil reducing device of claim 1, wherein said device being composed of a chromium-molybdenum material.

7. The recoil reducing device of claim 1, wherein said core includes a shoulder portion extending outwardly from said inner end portion, said rear face of said sleeve being in abutting relationship with said shoulder portion.

8. The recoil reducing device of claim 1, further comprising means for preventing relative motion between said core and said sleeve.

9. The recoil reducing device of claim 8, wherein said means for preventing relative motion between said core and said sleeve includes at least one threaded opening in each of said inner longitudinal wall and said outer longitudinal wall, each said threaded opening in said inner longitudinal wall being aligned with a threaded opening in said outer longitudinal wall and receiving a fastener.

10. A recoil reducing device for use with a firearm, comprising:

a core having an outer surface, a cylindrical bore and including a bore axis and an inner longitudinal wall, a plurality of inner openings through said inner longitudinal wall and being substantially forwardly oriented at an angle of about 45° relative to said bore axis and having forward walls, countersunk portions communicating with said inner openings and extending inwardly from said outer surface, said countersunk portions including forward wall portions oriented substantially perpendicularly to said bore axis; and a sleeve in surrounding relationship to said core, said sleeve including a rear face and an outer longitudinal wall, a plurality of outer openings through said outer wall and being oriented perpendicularly to said bore axis and directly aligned in open communication with said inner openings so as to form a continuous discharge passageway such that substantially all gases expelled through said inner and outer openings are directed away from a shooter.

11. The recoil reducing device of claim 10, comprising first and second sets of aligned inner and outer openings, said first set of openings being disposed in spaced relationship with one another about the periphery of said recoil reducing device, and said second set being disposed only along a longitudinal portion of said recoil reducing device.

12. The recoil reducing device of claim 10, wherein said core includes interior threads at an inward end portion for attaching said recoil reducing device to the firearm.

13. The recoil reducing device of claim 11, wherein said core includes interior threads at an inward end portion for attaching said recoil reducing device to the firearm.

14. The recoil reducing device of claim 10, wherein said device being composed of a chromium-molybdenum material.

15. The recoil reducing device of claim 10, wherein said core includes a shoulder portion at a rearward end portion in abutting relationship with said rear face of said sleeve.

16. The recoil reducing device of claim 10, further comprising means for preventing relative motion between said core and said sleeve.

17. The recoil reducing device of claim 16, wherein said means for preventing relative motion between said core and said sleeve includes at least one threaded opening in each of said inner longitudinal wall and said outer longitudinal wall, each said threaded opening in said inner longitudinal wall being aligned with a threaded opening in said outer longitudinal wall and receiving a fastener.

18. A recoil reducing device for use with a firearm, comprising:

a core having an inner end portion, an outer surface, a cylindrical bore defining a bore axis and an inner longitudinal wall, a plurality of inner openings extending through said inner longitudinal wall and being substantially forwardly oriented at an oblique angle relative to said bore axis, said inner openings including outer countersunk portions having forward wall portions adjacent to said outer surface and being oriented substantially perpendicularly to said bore axis; and a sleeve surrounding said core, said sleeve including a rear face and an outer longitudinal wall, a plurality of outer openings extending through said outer longitudinal wall being oriented perpendicularly to said bore axis and directly aligned in open communication with said inner openings such that substantially all gases expelled from the firearm during firing are directed away from a shooter.

19. The recoil reducing device of claim 18, wherein said inner and outer openings have a generally cylindrical shape and are generally equally spaced along the length of and about said recoil reducing device.

* * * * *